US006588618B1

(12) United States Patent
Davis

(10) Patent No.: US 6,588,618 B1
(45) Date of Patent: Jul. 8, 2003

(54) MOLDED PLASTIC CONTAINER, SNAP RING AND LID COMBINATION

(75) Inventor: Christopher L. Davis, Shelby Township, MI (US)

(73) Assignee: Letica Corporation, Rochester, MI (US)

( * ) Notice: Subject to any disclaimer, the term of this patent is extended or adjusted under 35 U.S.C. 154(b) by 0 days.

(21) Appl. No.: 09/842,974

(22) Filed: Apr. 26, 2001

(51) Int. Cl.[7] ..... B65D 51/18

(52) U.S. Cl. ..... 220/254.7; 220/783; 220/284; 220/698

(58) Field of Search ..... 220/254.1, 254.7, 220/783, 789, 790, 791, 284, 797, 798, 695–702

(56) References Cited

U.S. PATENT DOCUMENTS

| | | | | | |
|---|---|---|---|---|---|
| 606,838 | A | * | 7/1898 | Heins | 220/798 |
| 834,191 | A | | 10/1906 | Chambers | |
| 2,084,084 | A | | 6/1937 | Greer | |
| 2,663,455 | A | | 12/1953 | Sebell | |
| 3,469,735 | A | | 9/1969 | Burt | |
| 4,180,179 | A | | 12/1979 | Hoenig et al. | |
| 4,356,930 | A | * | 11/1982 | Roper | 220/783 |
| 4,397,404 | A | | 8/1983 | Blanchette | |
| 4,458,825 | A | | 7/1984 | Holota | |
| 4,512,494 | A | | 4/1985 | Von Holdt | |
| 4,530,442 | A | * | 7/1985 | Vogel et al. | 220/798 |
| 4,619,373 | A | * | 10/1986 | Galer | 220/783 |
| 4,667,843 | A | * | 5/1987 | Galer | 220/798 |
| 5,097,977 | A | | 3/1992 | Straub | |
| 5,181,626 | A | | 1/1993 | Daenen et al. | |
| 5,307,949 | A | * | 5/1994 | Von Holdt, Jr. | 220/783 |
| 5,568,879 | A | | 10/1996 | Kovathana | |
| 5,758,971 | A | | 6/1998 | Goglio et al. | |
| 5,842,593 | A | * | 12/1998 | von Holdt | 220/789 |

* cited by examiner

*Primary Examiner*—Nathan J. Newhouse
(74) *Attorney, Agent, or Firm*—Young & Basile P.C.

(57) ABSTRACT

An injection molded polyethylene paint can comprising the combination of a straight sided plastic container having a snap ring structure spin-welded to the upper peripheral edge thereof and a snap-on lid. The snap ring structure is of the reentrant design and provides an annular locking structure radially interior of a large volume depression. A snap-on lid has legs which fit over the annular structure and sealingly engage inward and outward exterior surfaces thereof. The lid further comprises a pry ring which lies within the large annular depression of the reentrant portion of the snap ring. A brush wiper ring may be provided integrally with the snap ring. All components are nestable and stackable; the containers are stackable with and without the snap ring.

15 Claims, 4 Drawing Sheets

MOLDED PLASTIC CONTAINER, SNAP RING AND LID COMBINATION

FIELD OF THE INVENTION

This invention disclosure relates to containers and particularly to molded plastic containers having permanently attached snap rings and removable lids.

BACKGROUND OF THE INVENTION

It is well known that paint is typically sold in metal one gallon cans which are generally cylindrical in shape. Welded metal cans have a ring structure with annular grooves added to the top of the can to receive a lid in such a way as to provide an air-tight seal, to permit the lid to be pried off with a tool, and to permit the lid to be reapplied to the container.

Containers made from high density plastics such as polyethylene have numerous advantages over metal containers; for example, plastic containers are far less susceptible to denting and are virtually rust proof. Therefore, it would be desirable to replace metal cans with plastic containers. However, plastic containers are typically not cylindrical and are incompatible with the machinery currently used to fill and seal metal cans.

SUMMARY OF THE INVENTION

The overall objective of the present invention is to provide a plastic container construction consisting of the combination of an open-top container, a snap ring permanently affixed to the top edge of the container, and a removable lid, which provides durability, excellent sealing qualities and, if desired, can be made in a shape with emulates traditional metal paint can so as to be compatible with handling machinery for traditional metal paint cans.

In particular, an objective of the present invention is to provide a plastic container structure in which an improved seal is provided between the lid and a snap ring structure which is tolerant of rough handling and lateral loading but which readily admits of the use of a simple tool such as a screwdriver to pry the lid from the snap ring. Other objectives include the provision of an internal brush ring integral with the snap ring, and stackability features for the cans and all of the related components, both alone and in combination.

In general these advantages are achieved through the provision of a snap ring structure which is adapted to be affixed to the top edge of an open top container which is preferably but not necessarily cylindrical; i.e., the invention works with tapered containers and non-round containers. As stated above, the preferred shape for the container is cylindrical but the features and advantages of the invention are applicable to other shapes. The snap ring structure is "reentrant" in design; i.e., it exhibits a depressed center structure which, in general, lies below a plane defined by the top edge of the container. As hereinafter described in detail, the snap ring defines a peripheral section defining an inverted unshaped groove for receiving the top edge of the container. Inboard there is a reentrant section which forms an annular depression lying mostly or entirely below the top plane. Inboard of that is an upstanding annulus which is contiguous with the annular depression to provide a primary seal and lock element when combined with a suitable lid. The combination further comprises a lid having an inverted U-shaped section which receives the upstanding annulus of the snap ring and conforms in sealing engagement with both the radially inner and outer exterior surfaces of the annulus. Finally the lid structure has an integral pry ring which, when the lid is applied to the snap ring, lies within the upper portion of the annular depression of the snap ring to permit the introduction of a tool to pry the lid from the snap ring.

Further objectives and advantages are achieved in optional features of the present invention described in the following specification with respect to several illustrative embodiments of the invention. These advantages include a novel brush wiper ring which is integral with the inner edge of the snap ring so as to permit the end user to wipe excess paint from a brush which has been dipped into the contents of the container. The preferred wiper ring is formed with a plurality of circumferentially arranged apertures to permit paint to be poured therethrough.

As will also be apparent from the following description of the preferred embodiments, the annular lock ring of the snap ring structure can be formed as either a solid single leg upstanding structure or as an inverted U-shaped loop structure having inner and outer legs which are resiliently displaceable toward and away from one another. The latter structure provides additional seal area and additional resistence to leakage due to rough handling.

The features and advantages of the present invention will be best understood by reference to the following description of the specific and illustrative embodiments of the invention.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENTS

Figure 1:
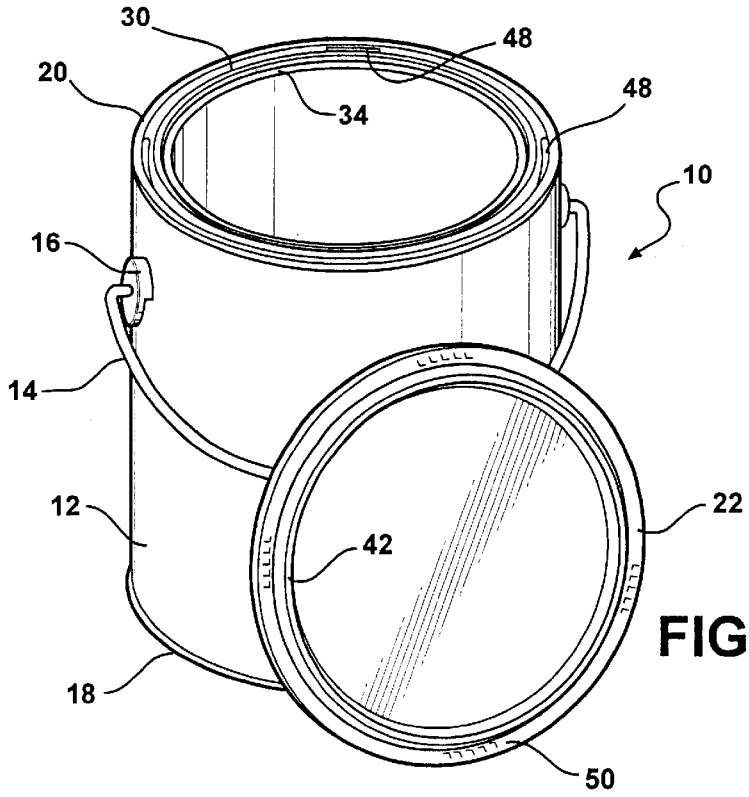
FIG. 1 is a perspective view of a one gallon paint can, snap ring and lid incorporating features and advantages of the present invention.

Referring first to FIG. 1, an injection molded plastic one gallon paint container 10 is shown to comprise substantially cylindrical container 12 having a bail 14 attached to the container by way of integral molded ears 16. Bail 14 may be metal or plastic. Although the container 12 shown in FIG. 1 is straight sided; i.e., cylindrical, it will be understood that the container may also be manufactured with a taper or non-round cross-section if desired. The bottom of the container 12 is closed and the sidewall is flared outwardly at the bottom to provide a detail 18 similar to the welded bottom of a metal paint can. Detail 18 is optional. The container 12 shown in FIG. 1 is preferably injection molded of high density polyethylene or polypropylene, but other materials can also be used.

The top of the container 12 is fitted with a snap ring 20 and a removable and resealable snap-on lid 22, both of which are injection molded of high density polyethylene. The snap ring 20 is fixed to the container 12 by spin welding, or any of several other available techniques.

Figure 2:
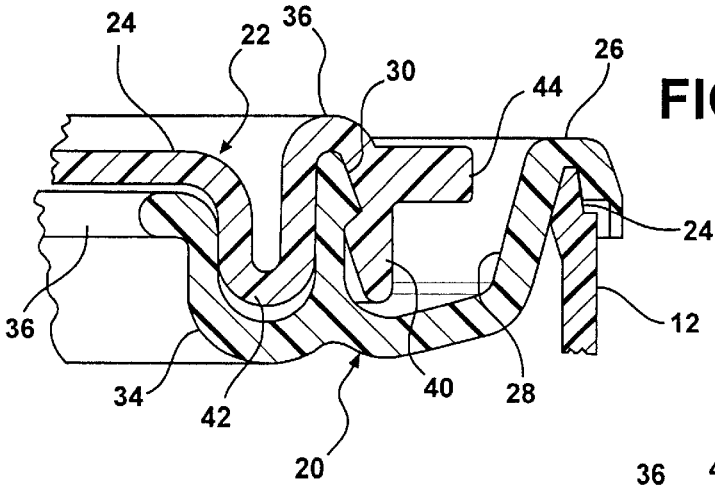
FIG. 2 is a cross sectional view of the container structure of FIG. 1.
Figure 3:
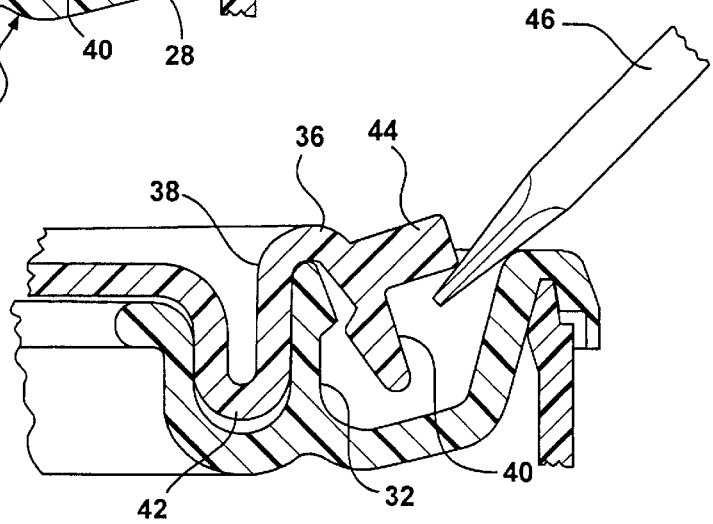
FIG. 3 is a cross sectional view of the structure of FIG. 2 showing how a prying tool is introduced thereinto.

Referring now to all of FIGS. 1 through 3, the upper open end of the container 12 terminates in a circular top edge defining a top plane. The outer surface of the top edge is relieved as shown at 24 to mate with the inside surface of an inverted U-shaped peripheral groove formed in a peripheral section 26 of the snap ring structure 20 as best shown in FIGS. 2 and 3. In cross section, the snap ring structure further comprises a contiguous reentrant section 28 which extends downwardly into the interior volume of the container 12 when the snap ring is spin-welded to the container 12 as shown. The reentrant portion 28 defines a relatively large U-shaped annular depression which lies below the top edge plane of the container 12 in the assembled configuration and which terminates radially inwardly at a contiguous and integral upstanding annulus 30. The annulus 30 extends upwardly and essentially to the top edge plane of the container 12 and is undercut on the radially outward exterior surface as shown at 32 to provide a snap lock feature in combination with the leg 40 of the lid 22 when applied thereto.

The snap ring structure may optionally extend radially inwardly of the can as shown at 34 in FIG. 2 to define an upright U-shaped seal structure 34 which terminates at an inner circular edge 36 defining the interior opening to the contents of the container 12.

The structures thus far as described are all preferably injection molded plastic structures. The preferred materials of construction are high density polyethylene and polypropylene which have been shown to have highly advantageous physical characteristics including strength, durability, resistence to denting and dimensional stability.

Continuing with the description of the structure of FIGS. 1 through 3, the lid 22 which is also preferably injection molded of high density polyethylene or polypropylene comprises an inverted U-shaped annular section 36 having an inner leg 38 and an outer leg 40 to receive the upstanding annulus 30 of the snap ring in firm and secure sealing engagement therewith. The dimensions of the legs 38 and 40 and the spacing there between is such as to provide a contact seal on both the inward and outward exterior surfaces of the annulus 30. The leg 40 is shaped to receive and provide a snap lock engagement with the undercut 32 of the annulus 30 as shown in FIG. 3.

The inner leg 38 of the lid extends downwardly into the U-shaped groove formed by the snap ring extension 34 to provide additional seal surface and blends in with a flat circular center section 24 which is suitable for receiving labels.

The lid 22 is provided with a pry ring 44 which is integral with the inverted U-shaped section 36 and which lies within the upper region of the large annular depression formed by the reentrant section 28 and the snap ring as shown in FIG. 2. In this location the pry ring 44 is spaced from reentrant section 28 to provide enough clearance for the introduction of a tool 46 such as a conventional screwdriver blade. The tool 46 releases the relatively compliant outer leg 40 of the lid from the undercut portion of the snap ring annulus 30 whereafter the lid may be released from the snap ring to gain access to the contents of the container 12.

In assembly the snap ring 20 is spin-welded to the top edge of the containers 12 in a known manner, lugs 48 being provided in the snap ring structure to be gripped by a suitable spin-welding tool as will be apparent to persons skilled in the art. Once the snap ring 20 is welded to the container 12, the container may be filled and the lid 22 may be applied. The snap ring may be welded using techniques other than spinning. Alternatively it may be adhesively bonded to the container.

Figure 4:
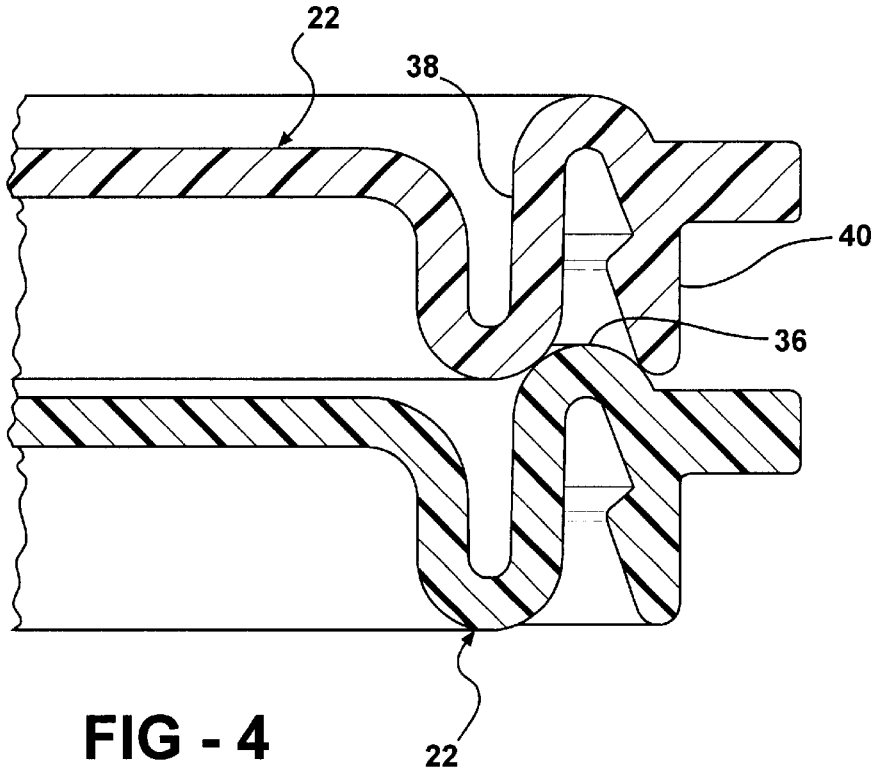
FIG. 4 is a cross sectional view of two lids showing the stacking and nesting relationship between them.

FIG. 4 illustrates how two lids 22 may be stacked one atop the other in a nesting relationship.

Figure 5:
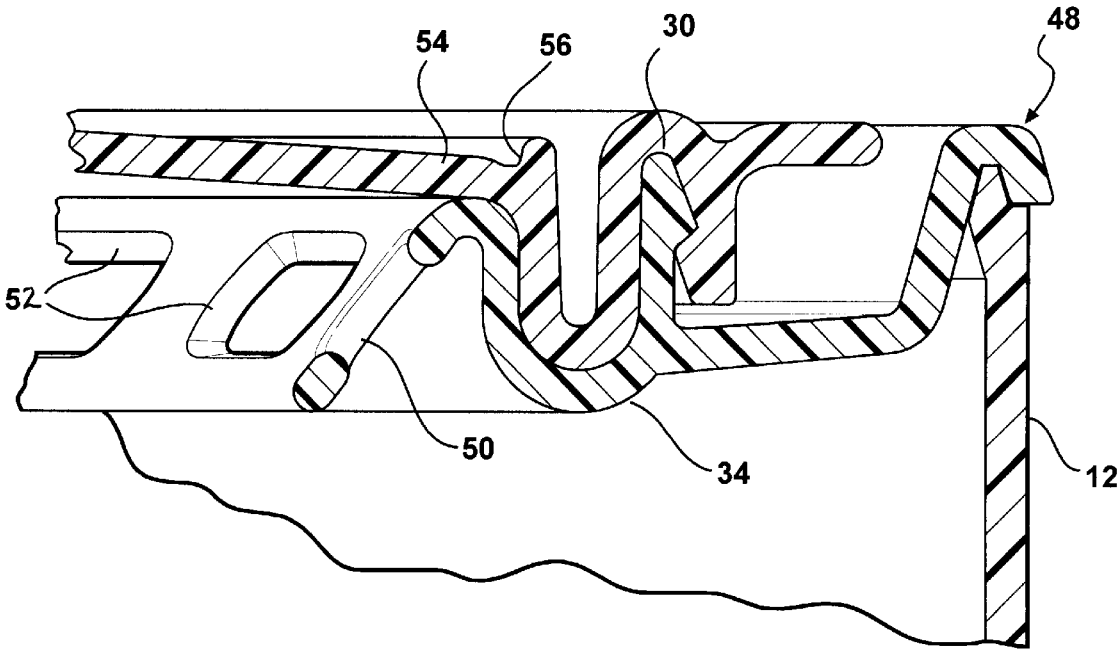
FIG. 5 is a cross sectional view of a second embodiment illustrating the optional brush wiper ring.

FIG. 5 illustrates another embodiment of the invention comprising a container 12 which is structurally identical to the container described with reference to FIGS. 1 through 3. The snap ring 48 is also generally similar to the snap ring 20 described above particularly insofar as the annulus 30 with its undercut configuration is concerned. However, in FIG. 5 the inward extension 34 includes an integral brush wiper ring 50 which, in the operative arrangement, lie within the confines of the container 12 and below the upper edge plane thereof. The brush ring provides a center opening so that a brush may be dipped into paint within the container 12. Thereafter excess paint on the brush may be removed conveniently by engagement with the edge of the wiper ring 50. Apertures 52 are formed in a spaced circumferential pattern around the ring 50 so that paint can flow through the wiper ring when the container is tipped.

In FIG. 5 the lid 54 is generally similar to the lid 22 described above but is provided with an additional feature 56 for stacking stability.

Figure 6:
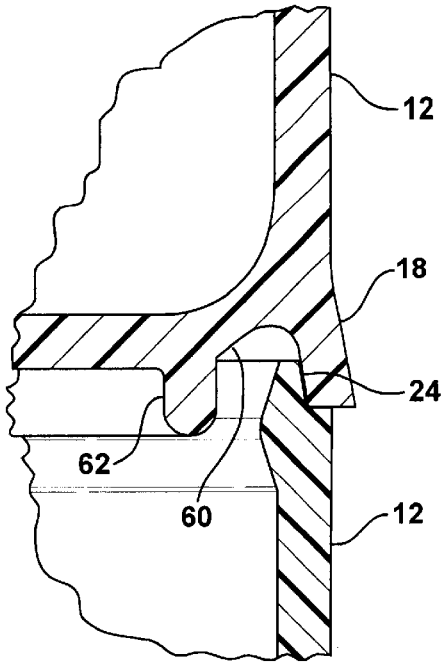
FIG. 6 is a sectional view of a portion of two stacked containers prior to the affixation of snap rings and lids thereto.
Figure 7:
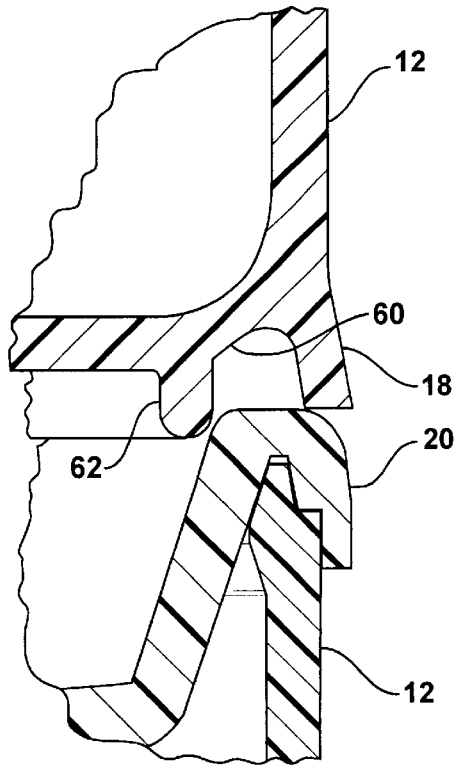
FIG. 7 is a cross section of the detail of two stacked containers after the affixation of the snap ring to the lower container.

Referring now to FIGS. 6 and 7, additional details of the container 12 are illustrated to show additional stackability features. The container 12, as described above, is provided with a flared bottom detail 18 and directly inwardly thereof an inverted U-shaped annular recess 60 defined by an annular inner ring 62. As shown in FIG. 6, these details allow containers 12 to be stacked and nested atop one another with great stability even before the snap ring is attached. The vast majority of prior art devices require the snap ring to be attached before container stacking which can be achieved with any stability.

In FIG. 7, it is shown how the details 60 and 62 add stability to the stacked containers after the snap ring 20 has been applied to the lower container 12.

Figure 8:
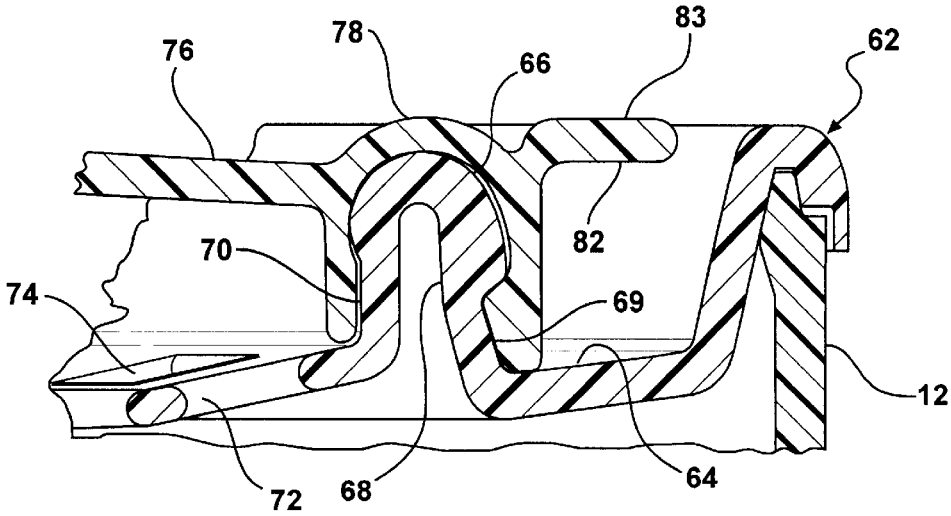
FIG. 8 is a cross sectional view of an alternative embodiment of the invention illustrating a loop type lock ring on the snap ring structure and a brush wiper ring.

Referring now to FIG. 8, a still further embodiment of the invention is illustrated. Again the container 12 is structurally identical to the containers described above. The snap ring 62, however differs from the snap ring described above. The snap ring 62 has a reentrant section 64 defining a large U-shaped annular depression which provides the pry off feature previously described and which also results in a location of the lid 76 at or slightly above the top plane of the container 12 after the lock ring 62 has been applied. The reentrant of portion 64 extends inwardly to an integral loop-type upstanding annular section 66 having radially outer and inner legs 68 and 70 which are spaced apart from one another to add compliance to the structure. This has been found to increase the area and improve the quality of the seal between snap ring and lid under heavy loading and rough handling conditions.

The lid is provided with inverted U-shaped section 78 which snaps over and mates with the legs 68 and 70 of the snap ring in sealing engagement over more than 180 degrees of included angle around the surface of the section 66. Again the undercut feature is provided at 69 for locking the lid to the snap ring. The lid 76 has a pry-ring 83 with molded-in features to provide a plurality of pocket-shaped relief areas 82 in the lower surface.

In FIG. 8 the snap ring structure is provided with a brush wiper ring 72 having apertures 74 arranged in a circumferential pattern to provide the functional advantage as described above.

Figure 9:
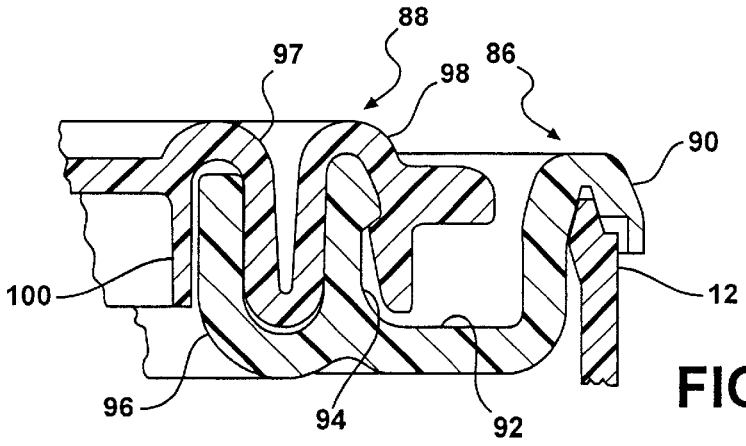
FIG. 9 is a partial, sectional view of another alternative snap ring and lid design.

Referring now to FIG. 9, a still further embodiment of the invention is shown to comprise a container 12, a snap ring 86 and a lid 88. The snap ring 86 is generally similar to the snap ring 20 of FIG. 2 in that it comprises the peripheral section 90, the reentrant groove 92 and the upstanding annular prong 94. Ring 86 further comprises an inner leg 96 similar to leg 34 of FIG. 2 but the leg 96 ends in a fully upright section as shown.

Lid 88 is also generally similar to lid 22 of FIG. 2 in providing an inverted unshaped section 98 which receives and lockingly mates with the prong 94. However, lid 88 has a second loop defining a second inverted u-shaped section 97 having a leg 100 which extends down the inside of ring leg 96 to stabilize and strengthen the structure.

Figure 10:
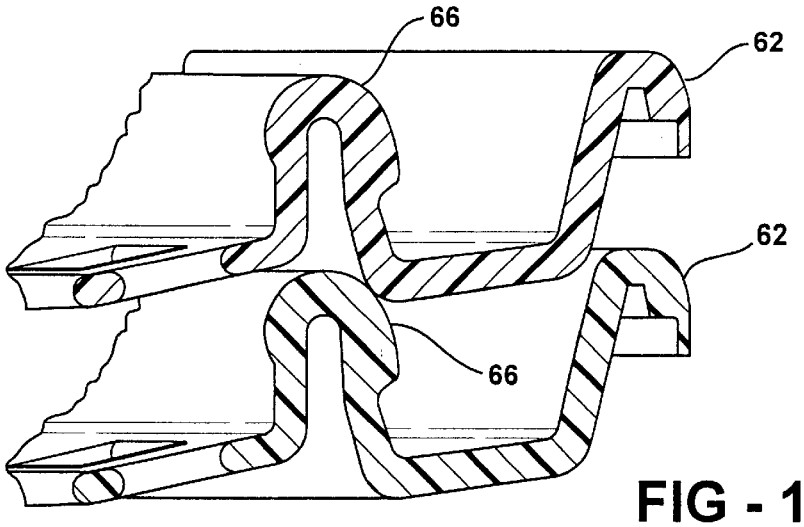
FIG. 10 is a partial, sectional view of two stacked snap rings of the type shown in FIG. 8.

FIG. 10 shows two of the snap rings 62 of FIG. 8 stacked one atop the other. The loop-type annular lock rings 66 provide a nesting feature which stabilizes the stacked rings.

Figure 11:
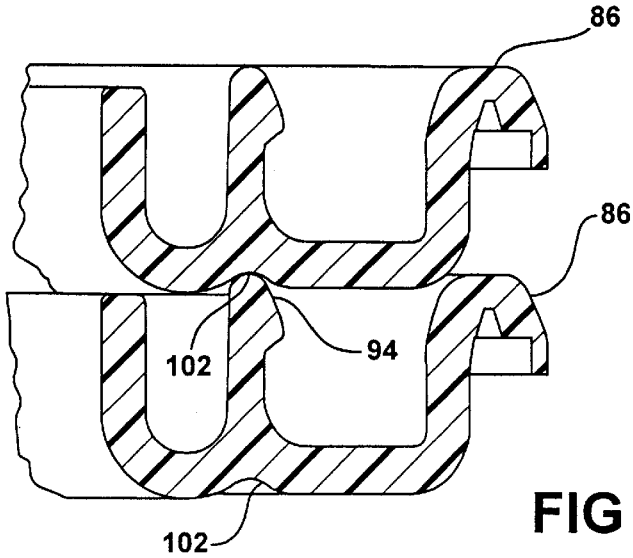
FIG. 11 is a partial, sectional view of two stacked snap rings of the type shown in FIG. 9.

FIG. 11 shows two snap rings 86 of the FIG. 9 type stacked one atop the other. An annular recess 102 receives the top of the annular prong 94 to provide a nesting feature.

It is to be understood that the invention has been described with reference to a specific and illustrative embodiment thereof and that persons skilled in the art of designing and manufacturing molded plastic containers and components thereof will see various ways in which the configuration of the structure may be modified.

What is claimed is:

1. For use in combination as a resealable container:

the container body having a sidewall with a top edge defining a top plane;

a snap ring attached to the top edge and comprising:

a. an inverted U-shaped annular peripheral groove defined by an outside leg and an inside leg for receiving the top edge of the container;

b. a reentrant section forming a continuous depression inwardly of the top edge contiguous with the inside leg and extending below the top plane and into the enclosed volume of the container; and c. an upstanding annular section inwardly contiguous with the reentrant section and extending substantially to the top plane and having inner and outer exterior surfaces, an undercut on the outer surface, said depression lying between the inside leg and the upstanding annular section; and a lid for lockingly and sealingly engaging the snap ring, the lid comprising:

an inverted U-shaped section which receives the upstanding annular section of the snap ring, said annular section having inner and outer interior surfaces for sealing engagement with the outer surfaces of the upstanding annular section, the outer interior surface of the inverted U-shaped section being formed to sealingly mate with the undercut of the lock ring; and a pry-ring outwardly contiguous with the inverted U-shaped section so as to be disposed at least partially in the depression formed by the reentrant section in the vicinity of the top plane, the entirety of the lid being spaced sufficiently inwardly of the inside leg of the reentrant section to permit the introduction of a tool.

2. The combination defined in claim 1 wherein the snap ring further comprises a radially inward extension section contiguous with the upstanding annular section and extending into the interior volume of the container when the snap ring is joined to the container.

3. The combination defined in claim 2 further including a brush wiper ring contiguous and formed by said radially inward extension.

4. The combination defined in claim 3 further comprising a plurality of circumferentially arranged apertures in the wiper ring to permit fluid to be poured from the container therethrough.

5. The combination defined in claim 1 wherein the snap ring is welded to the top edge of the container.

6. The combination defined in claim 1 wherein said container further comprises a closed bottom having a peripheral edge and an inverted U-shaped groove formed immediately inwardly of said peripheral edge, the groove being configured to nest with the top edge of an identical container both with and without the snap ring attached thereto.

7. The combination defined in claim 1 wherein the upstanding annular section of the snap ring is formed in cross section as an inverted U-shaped loop having radially inner and outer legs interspaced from one another.

8. The combination defined in claim 7 further comprising a brush wiper ring integral with the inner leg of said loop section and extending radially into the inner and upper volume of the container.

9. The combination defined in claim 8 further comprising a plurality of apertures formed in brush wiper rings to permit fluid to be poured therethrough.

10. The combination defined in claim 1 wherein the container and snap ring and lid are all formed of injection moldable plastic.

11. The combination defined in claim 10 wherein the injection moldable plastic is chosen from the group consisting of polyethylene and polypropylene.

12. The combination defined in claim 1 wherein the pry ring of the lid has a lower surface and circumferential rings formed on the lower surface.

13. The combination defined in claim 1 wherein the pry ring is formed with a plurality of pocket shaped relief areas in the lower surface thereof.

14. The combination defined in claim 1 wherein the container is cylindrical.

15. The combination defined in claim 1 wherein the lid has a U-shaped reentrant loop radially inwardly of the of the inverted U-shaped section to add radial flexibility.

* * * * *